US008017848B2

(12) United States Patent
Manera

(10) Patent No.: US 8,017,848 B2
(45) Date of Patent: Sep. 13, 2011

(54) COMPACT PAGE TURNING DEVICE

(76) Inventor: Jeffrey J. Manera, Palm Beach Gardens, FL (US)

( * ) Notice: Subject to any disclaimer, the term of this patent is extended or adjusted under 35 U.S.C. 154(b) by 98 days.

(21) Appl. No.: 12/698,089

(22) Filed: Feb. 1, 2010

(65) Prior Publication Data

US 2011/0188231 A1 Aug. 4, 2011

(51) Int. Cl.
*G10G 7/00* (2006.01)

(52) U.S. Cl. ..... 84/486

(58) Field of Classification Search ..... 84/486–490, 84/500–507, 509, 513, 516, 518
See application file for complete search history.

(56) References Cited

U.S. PATENT DOCUMENTS 7,435,892 B1 * 10/2008 Goin et al. ..... 84/486

* cited by examiner

*Primary Examiner* — Kimberly Lockett
(74) *Attorney, Agent, or Firm* — Joseph Stecewycz

(57) ABSTRACT

The present invention provides an apparatus for turning the pages of books. The page turning apparatus includes a housing which receives the book. Further, the page turning apparatus includes a shaft having single or multiple protrusions. The shaft rotates and one or more of the protrusions attached to the shaft act through a number of steps to lift the page, and subsequently push the page as the shaft moves linearly to complete the page-turning process and then reset so the process can be repeated. The rotational motion and the linear motion are provided by one or more energy means. Also, the energy means provides a rotational and a linear motion to the shaft for turning the page of the book. In addition, the rotational motion of the shaft is followed by the linear motion along a horizontal axis of the housing.

20 Claims, 6 Drawing Sheets

COMPACT PAGE TURNING DEVICE

FIELD OF THE INVENTION

The present invention relates to a compact page turning apparatus for mechanically turning the pages of a book.

BACKGROUND OF THE INVENTION

Turning the page is an intrinsic component of reading that is most often taken for granted until the time that the activity becomes difficult to perform owing to illness or disability. Further, in playing music, the activity needs special consideration owing to the fact that both hands of the musician are occupied and to read the music from sheets, pages have to be turned one by one without creating a break in the music and without the aid of another person. In both scenarios, the need exists for a device or a mechanism that will keep the book or collection of pages flat, engage one page at a time, and turn each page silently and smoothly at the right time.

As examples of known art, reference is made to U.S. Pat. No. 4,102,071 wherein there is disclosed an adjustable page turning apparatus. This page turning apparatus comprises a transparent housing having a hinged top which can include a magnifying glass of some type. Operably arranged within the housing and supported by a plurality of pulleys is a monofilament cable having each end thereof connected to a slip-clutch assembly. The slip-clutch assembly includes a slip-clutch disc and a disc-wheel, wherein the cable ends are attached to the slip-clutch disc which causes the cable to move when rotated.

Again in U.S. Pat. No. 4,031,644, a page turning apparatus is provided in which the pages of a book can be turned by remote control. The page turning apparatus comprising a mounting board or frame for supporting a book and having a reversible electric motor mounted thereon. The motor having an output shaft extending there from over and generally parallel to the mounting board or frame and being pivotally mounted for swinging of the output shaft through limited angles across and perpendicular to the mounting board or frame.

U.S. Pat. No. 279,737 discloses a leaf turning apparatus. The leaf turning apparatus consists of wire frames or fliers pivoted on the board of the musical instrument, usually employed for holding the music, or on a specifically provided board or frame, and contrived for application of sheet or book music, with pawls arranged for turning the sheet both ways by means of pull wires or cords to be worked by a foot-treadle or other device, and a spring for retracting them, and also for causing them to hold the wire frames down when turned.

Similarly, U.S. Pat. Nos.4,553,467, 4,432,154 and 4,870,258 also discloses the page turning apparatus.

All of these stated devices and some other devices presently known in the art have had some flaws in design or mechanism. Most of the existing devices are too expensive to be practical for most users. Some shortfalls of the existing devices include unreliable and noisy mechanisms, unwieldy preprocessing that needs clips or tabs to be attached to each page, and bulky devices with large components that reduce ease of portability.

In light of this, there is a need for a page turning device that overcomes these constraints and makes page turning an effortless, mechanical function that serves the needs of the handicapped as well as the musician or any other person wishing to automate the page-turning process.

BRIEF SUMMARY OF THE INVENTION

The present invention is directed to an apparatus for turning the pages of books. In an embodiment of this invention, the page turning apparatus includes: a housing, a shaft operatively connected to the housing, multiple protrusions on the shaft and one or more energy means. The housing of the apparatus receives a book. The shaft rotates to whirl a page of the book and subsequently moves linearly to turn the page. The protrusions make contact with the page for whirling it. Also, the energy means provides a rotational and a linear motion to the shaft for turning the page of the book. In addition, the rotational motion of the shaft is followed by the linear motion along a horizontal axis of the housing.

In embodiments, the housing includes multiple adjustable walls defining a compartment. The size of the compartment is adjusted based on the size of the book. In embodiments, the housing includes track rails for holding the shaft.

In embodiments, protrusions can be bolts, screws, rubber caps, and the like. In embodiments, the bolts or screws or rubber caps are received by holes in the shaft in a direction perpendicular to the axis of the shaft. In addition, a first and a second portion of each of the bolts or screws or more rubber caps are diametrically opposite and remain outside the shaft. Further, the third portion of the bolts or screws or more rubber caps remains inside the corresponding holes. The first portion of each of the bolts or screws or rubber caps makes contact with the page during the rotational motion of the shaft.

In embodiments, energy means turn the page in one of a forward direction and a backward direction.

In embodiments, the page turning apparatus also includes a micro-controller which is configured to control the rotational and the linear motion of the shaft based on predefined criteria. The predefined criteria can be the size of the book and direction of turning the page.

In embodiments, the page turning apparatus also includes a lighting source operatively coupled to the adjustable housing for providing lighting to the reader. The lighting source can be one of a gooseneck light, LED array, and optical fiber lights.

In embodiments, the page turning apparatus also includes a user interface for providing commands to turn the page. The user interface can be one of mechanical interface, touch screen based interface, voice command based interface, and the like. In embodiments, the commands can be given wirelessly or by using a wired connection.

In embodiments, the page turning apparatus includes a sheet for keeping the pages of the book flat.

In embodiments, the sheet is hinged to the edges of the adjustable housing. In addition, the sheet can also embed lighting source.

In embodiments, the energy means can be stepper motors for providing the rotational motion to the shaft. In embodiments, the energy means can be linear actuators for providing the linear motion to the shaft.

In other embodiment of the present invention, the page turning apparatus for books includes a housing, a shaft operatively connected to the housing, protrusions on the shaft, a transparent screen attached to the housing, and one or more energy means. The housing of the apparatus receives the book. The shaft rotates to whirl a page of the book and subsequently moves linearly to turn the page. The protrusions make contact with the page for whirling the page. The one or more energy means provides a rotational and a linear motion to the shaft for turning the page of the book and to the transparent screen. The rotational motion of the shaft is followed by the linear motion along a horizontal axis of the housing. The sheet opens up before the turning of the page and closes after the page is turned.

In embodiments, the sheet is attached to the housing using a hinge mechanism. In embodiments, the microcontroller controls one or more energy means for rotation of the transparent screen, rotational motion of the shaft and the linear motion of the shaft using a predefined criteria.

In another embodiment of the present invention, the page turning apparatus includes a housing, a shaft operatively connected to the housing, one or more protrusions on the shaft, a spring mechanism to support and flatten the pages of book, a sheet attached to the housing, a first stepper motor for providing rotational motion to the shaft to whirl the page, a linear actuator to provide a linear motion to the shaft, and a second stepper motor to provide a rotational motion of the sheet. The shaft rotates to whirl a page of the book and subsequently moves linearly to turn the page. The protrusions make contact with the page for whirling the page. The rotational motion of the shaft is followed by the linear motion along a horizontal axis of the housing. The sheet opens up before the turning of the page and closes after the page is turned.

In embodiments, the sheet is attached to the housing using a hinge mechanism. In embodiments, the microcontroller controls one or more energy means for rotation of the transparent screen, rotational motion of the shaft and the linear motion of the shaft using a predefined criteria.

These and other systems, methods, objects, features, and advantages of the present invention will be apparent to those skilled in the art from the following detailed description of the preferred embodiment and the drawings. All documents mentioned herein are hereby incorporated in their entirety by reference.

BRIEF DESCRIPTIONS OF THE DRAWINGS

The systems and methods described herein may be understood by reference to the following figures.

While the above-identified figures set forth preferred embodiments of the invention, other embodiments are also contemplated, as noted in the discussion. In all cases, this disclosure presents the present invention by way of representation and not limitation. It should be understood that numerous other modifications and embodiments can be devised by those skilled in the art which fall within the scope and spirit of the principles of this invention.

DETAILED DESCRIPTION OF THE INVENTION

Figure 1:
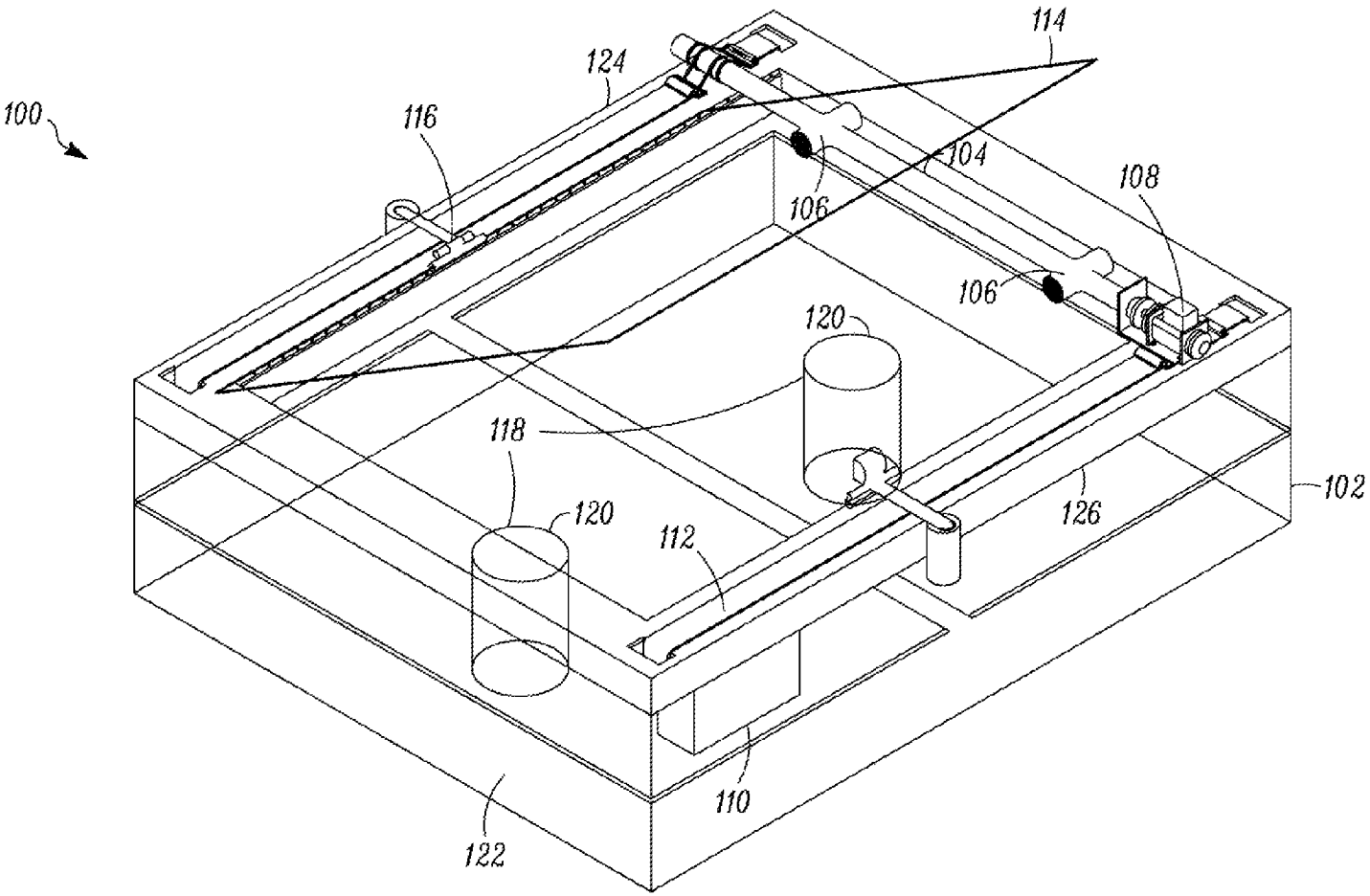
FIG. 1 illustrates a page turning apparatus in accordance with various embodiments of the present invention.

Referring now to the drawings where the showings are for the purpose of describing the preferred embodiment of the invention and not for limiting the same, FIG. 1 illustrates a page turning apparatus 100. The page turning apparatus 100 includes a housing 102. The housing 102 has multiple adjustable walls which defines a compartment. This compartment receives a book whose pages need to be turned. The size of the compartment can be adjusted based on the size of the book. For example, if the width of the book is more than the width of the compartment, then the walls of the housing 102 can be adjusted to increase the width of the compartment. The walls of the housing 102 can be adjusted by using appropriate mechanism presently known in the art.

It may be noted that the housing 102 of the page turning apparatus 100 is explained by using adjustable walls which defines a compartment; however those skilled in the art would appreciate that the page turning apparatus 100 can have rigid walls which can be used for some specific sizes of the books.

The page turning apparatus 100 also includes a shaft 104. The shaft 104 is operatively connected to the housing 102. In an embodiment of the present invention, track rails on the housing 102 can be used to hold the shaft 104. In another embodiment of the present invention, the housing 102 holds the shaft 104 by an appropriate arrangement presently known in the art.

The shaft 104 can be moved to and fro along the two parallel walls (say side walls 124 and 126) of the housing 102. In an embodiment of the present invention, the shaft 104 can be moved using a conveyor mechanism 112. In another embodiment of the present invention, the shaft 104 can be moved to and fro along two parallel walls by using an appropriate mechanism presently known in the art.

The shaft 104 has one or more protrusions 106. These protrusions 106 make contact with the page and turn it. In an embodiment of the present invention, a portion of these protrusions 106 makes contact with the page and turns it.

In an embodiment of the present invention, bolts, screws, rubber caps, and the like can be attached to the shaft 104 which acts as protrusions 106. For example, some standard sized bolts can be received by holes in the shaft 104 in a direction perpendicular to the axis of the shaft 104. A first portion and a second portion of the bolts (shown and explained later in conjunction with the description of FIG. 2B) are diametrically opposite and remain outside the shaft 104 while a third portion remains inside the holes. Firstly, the first portion of these bolts makes contact with the page and grips the page. The first potion of these bolts pulls the page from the edge. The second portion of the page rotates under the page to turn it. This movement of the page can be defined as whirling of the page. This whirling will be explained later in conjunction with the description of FIG. 2A, FIG. 2B and FIG. 2C.

The shaft 104 is rotated or moved by one or more energy means. These energy means can be one or more stepper motors, one or more linear actuators, and the like. In an embodiment of the present invention, a stepper motor 108 rotates the shaft 104 and whirls the page. As explained above, a portion of the protrusions 106 makes contact with the page during the rotation of the shaft 104 and whirls the page. In an embodiment of the present invention, the stepper motor 108 provides the rotational motion to the shaft 104. In another embodiment of the present invention, some other energy means presently known in the art can provide the rotational motion to the shaft 104.

Following the rotational motion, linear motion along the housing 102 to the shaft 104 is provided by using the appropriate energy means and appropriate mechanism to turn the whirled page. In an embodiment of the present invention, a linear actuator 110 and the conveyor mechanism 112 enable the turning of the whirled page. The whirling of the page by using the rotational motion and turning the whirled page using the linear motion has been explained in conjunction with the description of FIG. 2A, FIG. 2B and FIG. 2C.

In embodiments of the present invention, a microcontroller (not shown in the figure) controls and synchronizes the energy means. For example, the microcontroller controls and synchronizes the stepper motor 108 and the linear actuator 110. The microcontroller controls the energy means based on a predefined criteria. The predefined criteria can be the size of the book, direction of the turning of the page, and the like. In an embodiment of the present invention, the microcontroller directs the stepper motor 108 to provide a single rotation to whirl the page. In an embodiment of the present invention, the microcontroller directs the stepper motor 108 to provide multiple rotations to whirl the page. In an example, if the size of the book is large, the microcontroller gives the command to increase the number of rotations to be provided to the shaft 104 so that the page can be properly whirled. In the example, the microcontroller controls the linear motion to be provided to the shaft 104 so that it completely turns the whirled page.

In an embodiment of the present invention, the microcontroller can have a bookmarking facility. The user can bookmark a page of the book by using this facility. For example, the user may like to read page 66 of the book every morning. In this case, he may bookmark the page 66. The microcontroller may store some of the attributes corresponding to page 66. For example, the microcontroller may store the height of one part of the book at page 66. In an embodiment of the present invention, the microcontroller may store some other similar attributes of the book corresponding to the page 66.

Whenever the user wishes to open the bookmark page 66, the micro-controller will calculate the number of pages which it needs to whirl to open page 66. For example, the book may be opened at page 56. The user may wish to open the page 66 in the morning. In this case, the microcontroller will calculate that a rotational power for 10 pages is required. In an embodiment of the present invention, firstly the microcontroller provides commands to the stepper motor 108 to provide 10 rotations to the shaft 104. The 10 rotations will whirl the 10 pages of the book. Each page will be whirled after each rotation. Once all the pages are whirled, the microcontroller will provide commands to the linear actuator 110 to provide linear motion to the shaft 104. The linear motion of the shaft 104 will turn all the pages simultaneously.

In another embodiment of the present invention, the microcontroller provides timer functionality. The timer turns a page of the book in the page turning apparatus 100 after a set time. The time can be set by a user of the page turning apparatus 100.

In an embodiment of the present invention, the page turning apparatus 100 includes a sheet 114 to make the pages of the book flat before and after the turning of the pages, to allow clear reading of the book. In an embodiment of the present invention, the sheet 114 is connected to one of the sides of the housing 102 using a hinge mechanism 116. The arrangement of the sheet 114 with one of the walls has been explained in conjunction with the description of FIG. 3A and FIG. 3B. In an embodiment of the present invention, the sheet 114 is a magnifying sheet, providing magnification of the pages of the book. In an embodiment of the present invention, the sheet 114 can have magnification properties. The magnification properties will help the elder people to read the magnified pages. In an embodiment of the present invention, the user can use the sheets of different magnification power interchangeably. For example, in the current design, a sheet of less magnification power can be replaced by the sheet of the higher magnification power. In an embodiment of the present invention, the sheet 114 can be a transparent sheet, plastic sheet, and the like. In an embodiment of the present invention, the sheet has a reflective or partially reflective and/or one-way or partially one-way reflective film or coating which will enable reflection of the light downward to the pages.

In an embodiment of the present invention, the page turning apparatus 100 includes a lighting source (not shown in the figure). The lighting source can be a gooseneck light, LED array, optical fiber lights, and the like. In an embodiment of the present invention, the lighting source can be placed inside the walls of the housing 102 and can be powered using any of the energy means presently known in the art. In an embodiment of the present invention, the lighting source can be embedded within the sheet 114. In an embodiment of the present invention, an array of LEDs can be placed in any of the suitable places in the housing 102. The array of LEDs will illuminate the sheet 114 in a fiber optic manner which thereby will provide appropriate light to the user to read the book. In an embodiment of the present invention, the lighting source can be controlled by the microcontroller.

In an embodiment of the present invention, the housing 102 includes a spring loaded platform 118. The spring-loaded platform 118 will conform roughly to the dimensions of each half of the book and will serve to evenly support book halves from underneath, enabling flattening of the book and smooth turning of the pages by balancing both sides of the book at the same level. In an exemplary scenario, a user may like to read 399th page of a book which has 450 pages. In this scenario, the load on each side of the book will not be equal as the centre of gravity of the book will lie on the part of the book having more pages. This unbalancing of load can also restrict the process of turning of the pages. In an embodiment of the present invention, the load balancing mechanism 118 is attached on the housing 102 of the page turning mechanism 100. As shown in FIG. 1, a spring 120 on each side of the book can act as load balancing mechanism 118. The pair of springs 120 is attached on the inside bottom surface 122 of the housing 102. In an embodiment of the present invention, the page turning apparatus 100 includes multiple springs on each side of the book for load balancing. In another embodiment of the present invention, the load balancing mechanism 118 can be any suitable arrangement presently known in the art.

In an embodiment of the present invention, the page turning apparatus 100 includes a user interface for accepting commands to turn the page. The user interface is operatively coupled to the microcontroller. In an example, the user can provide commands to turn the page by using the user interface. The user interface transfers these commands to microcontroller and accordingly, the microcontroller provides the commands to the stepper motor 108 and the linear actuator 110. The user interface can be one of mechanical interface, touch screen based interface, voice command based interface, remotely controlled, or any other type of interface presently known in the art.

In an embodiment of the present invention, a fine wire is placed to center the book and keep it centered as the pages are advanced. The fine wire can be a guitar wire, a plano wire, and the like and is placed in the middle of the book when the book is first inserted and is locked down to keep the center of the book in the middle of the housing 102.

Figure 2A:
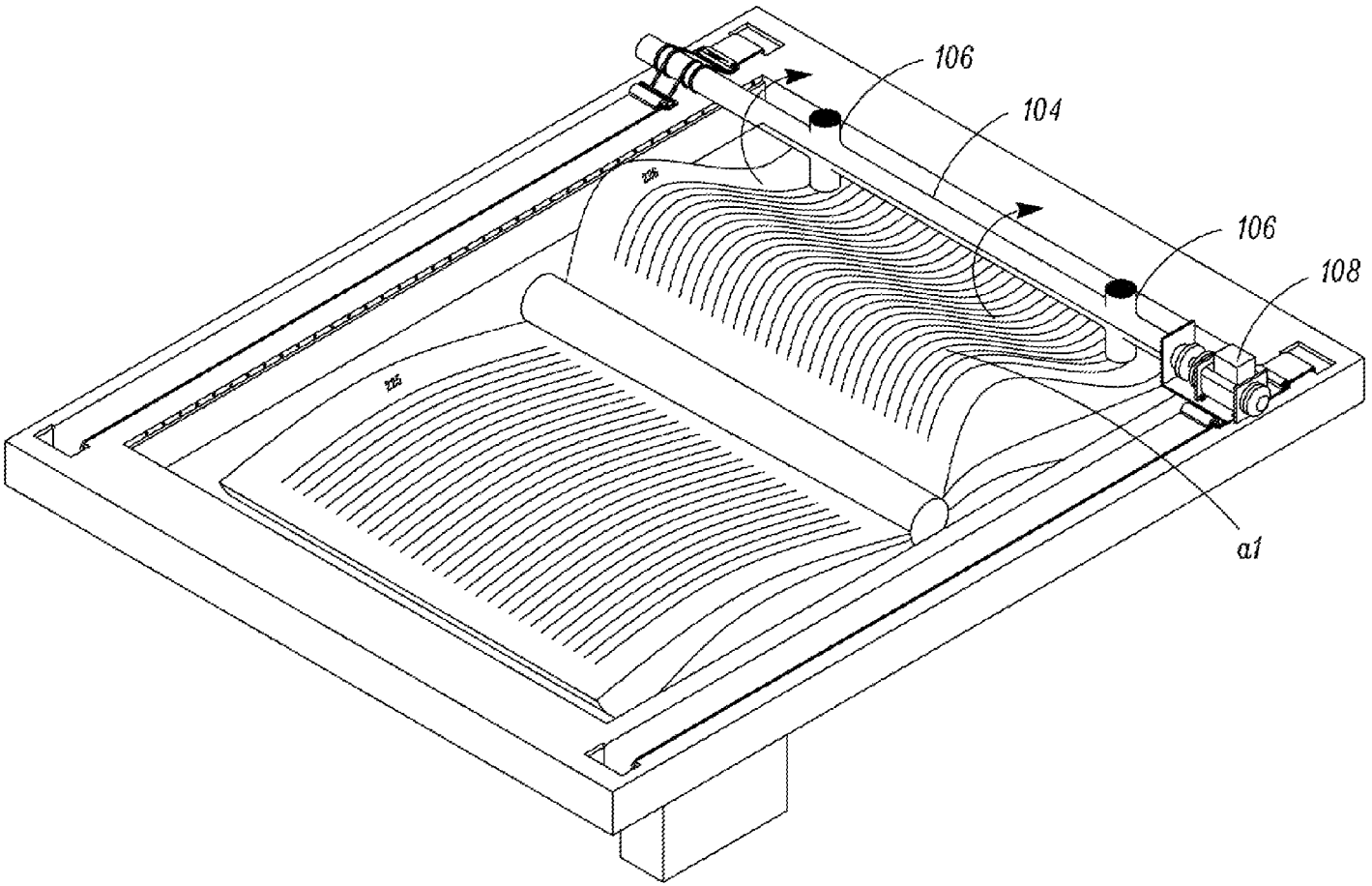
FIG. 2A depicts the whirling of a page by the rotational motion of a shaft in the page turning apparatus in accordance with various embodiments of the present invention.

FIG. 2A depicts whirling of the page by the rotational motion of the shaft 104 in accordance with various embodiments of the present invention. As mentioned above, a portion of the protrusions 106 makes contact with the page during the rotation of the shaft 104 and whirls the page.

Figure 2B:
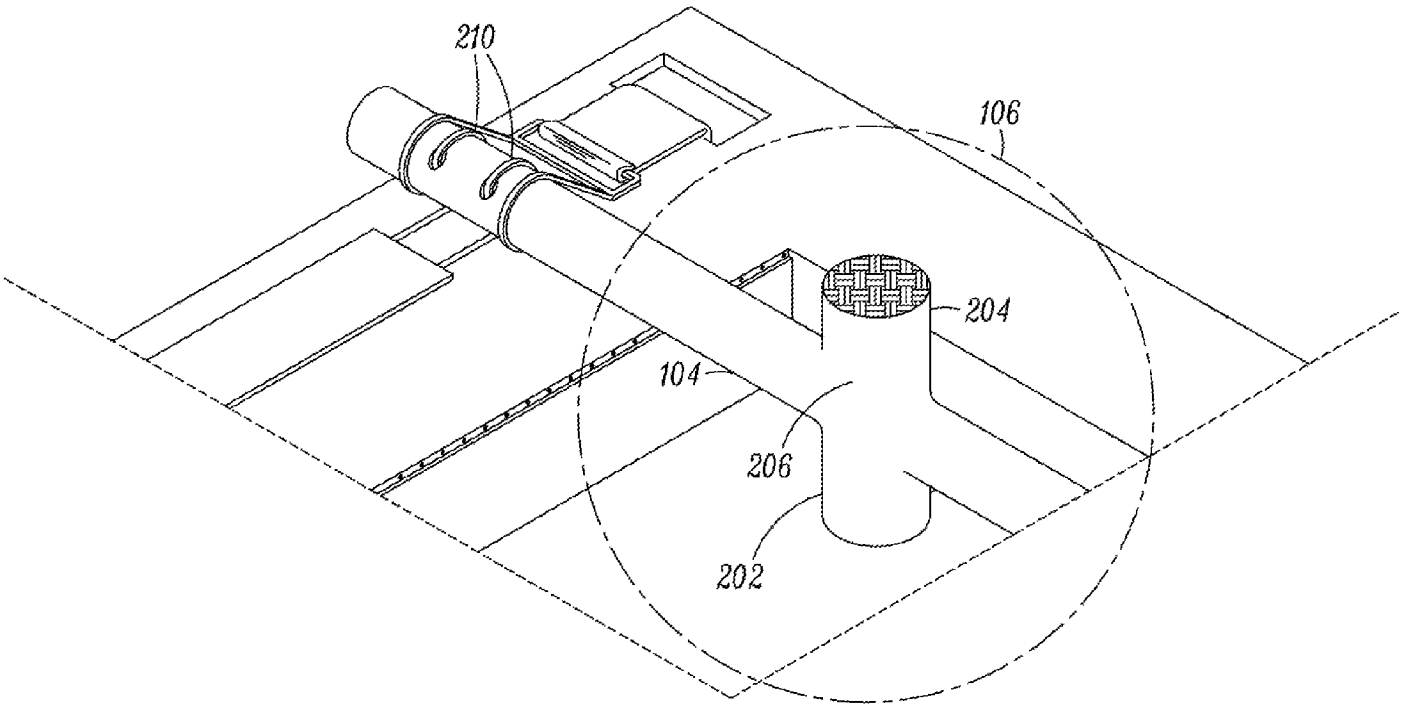
FIG. 2B depicts the various portions of protrusions of the shaft in accordance with various embodiments of the present invention.

As shown in FIG. 2B, a first portion 202 and a second portion 204 of the protrusions 106 are diametrically opposite and remain outside the shaft 104 while a third portion 206 remains inside the holes. In an embodiment of the present invention, the first portion 202 and the second portion 204 of the protrusion 106 can be called as two different protrusions, i.e. the first portion 202 can be a first protrusion and the second portion 204 can be the second protrusion. In an embodiment of the present invention, the first protrusion effectively grips and pulls the page for a short distance. As the shaft 104 rotates, the first protrusion rotates to prepare the page for the second protrusion/s to slip underneath it and be in position to push the page all the way to a completed page turn as the shaft 104 moves linearly. In an embodiment of the present invention, the shaft 104 is designed to provide adequate downward pressure on the protrusion to properly complete the gripping and turning process.

It may be noted that the rotational motion to grip and the pull the page in the present invention is explained by using the rotational motion provided by the stepper motor 108; however those skilled in the art would appreciate that the rotational motion can be provided by any other appropriate mechanism presently known in the art. One such mechanism can be hook/pullback mechanism. In this mechanism, a hook along with a ribbon on the edges of housing 102 allows the rod to rotate and provides the pull required to whirl the page. For example, as shown in FIG. 2B, there can be two ribbons or similar connectors connecting to the shaft 104. One ribbon will pull on anchored point/s 210 on the shaft 104, in such a manner as to cause rotation of the shaft 104 (i.e. from the direction the shaft 104 is to be advanced, to the left of the shaft 104). The second ribbon would connect to the shaft 104 with non-secured hooks or similar that allows it to rotate and provide enough resistance to cause the shaft 104 to rotate in clockwise direction when the first ribbon is pulling. The resistance can be accomplished by spring or elastic material within or attached to the ribbon or any method presently known in the art.

In an embodiment of the present invention, the first protrusion or the first portion 202 can be of any property and made of any material presently known in the art that will allow it to effectively grip and pull the page as the shaft 104 rotates. In an embodiment of the present invention, the second protrusions or the second portion 204 slips under the page or pushes the page in such a manner as to cause it to flip and push against the page as the shaft 104 advances linearly to complete the page-turning process.

In an embodiment of the present invention, the design and materials of the first protrusion can include sharp points (such as a needle or nail point), rubber caps, rubber half-circles or any other material or shape determined to be efficient to grip and pull the page, including a combination of materials such as sharp points extending from rubber-like material.

In an embodiment of the present invention, the second protrusion extends at some different angle from the shaft than the angle of the first protrusions. As shown in FIG. 2B, the first and second protrusion can be directly opposite. It may be noted that the first and second protrusion in FIG. 2B is shown to be directly opposite (at an angle of 180 degrees). However, those skilled in the art would appreciate that the angle between the first and second protrusion can vary from 90 degrees to 270 degrees.

It may also be noted that there can be one or more set of first set of protrusions and one or more second set of protrusions on the shaft 104. In an embodiment of the present invention, there may only be one set of protrusion/s, accomplishing all the processes described above by the distance and timing of the shaft 104 rotation. In an embodiment of the present invention, the two sets of protrusion/s may have the same properties, same materials, and can still accomplish the page-turn.

In an example, the first portion 202 and the second portion 204 can be made by using standardized bolts. These standard sized bolts can be received by holes in the shaft 104 in a direction perpendicular to the axis of the shaft 104. The first portion 202 of the bolt effectively grips and pulls the page for a short distance. As the shaft 104 rotates, the first portion 202 rotates to prepare the page for second portion to slip underneath it and be in position to push the page all the way to a completed page turn as the shaft 104 moves linearly. In the FIG. 2A, a page al of the book is shown to be gripping and pulling the page.

Figure 2C:
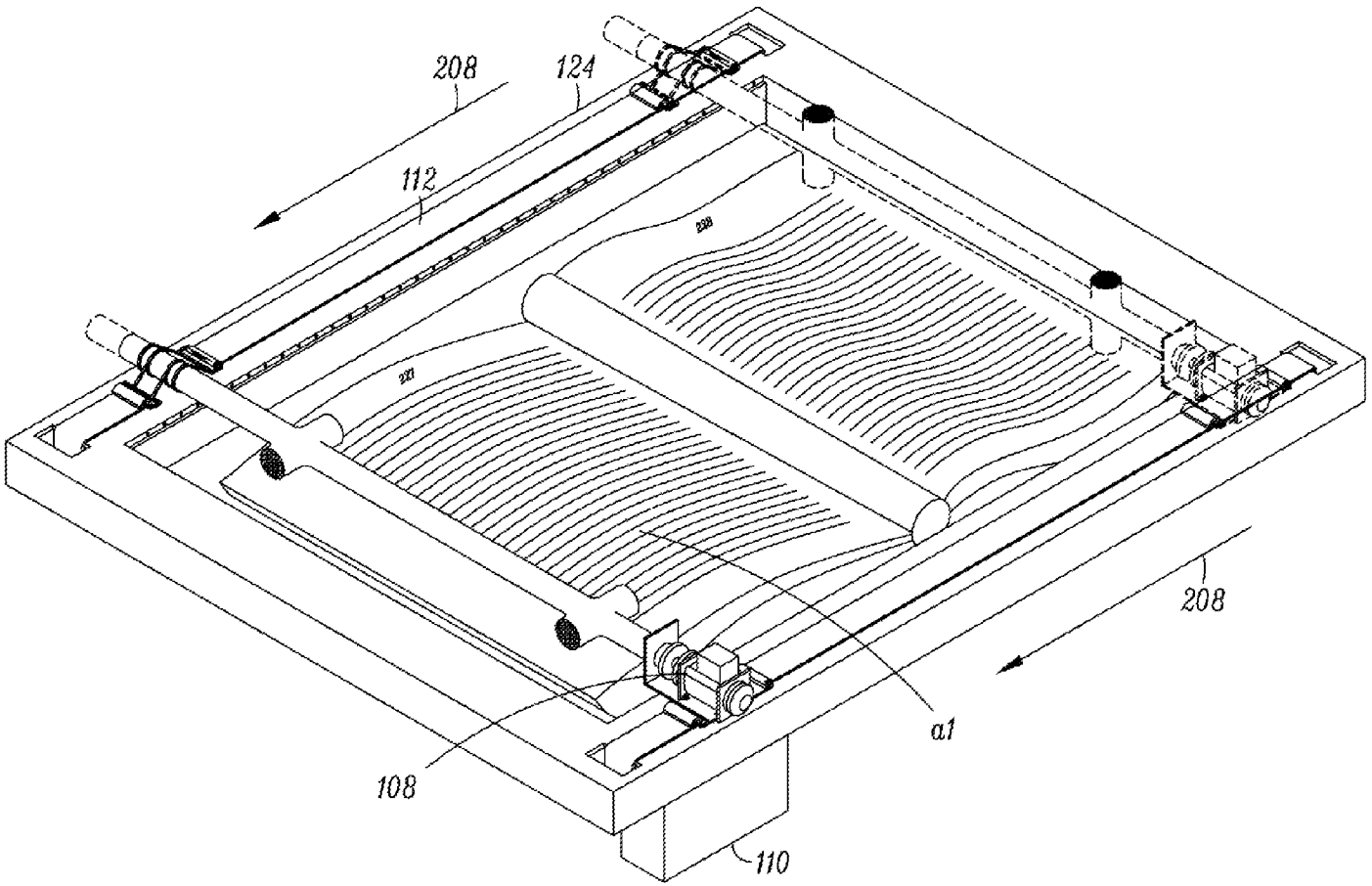
FIG. 2C depicts the turning of the whirled page by the linear motion of the shaft in accordance with various embodiments of the present invention.

Following the rotational motion, as shown in FIG. 2C, the shaft 104 is moved linearly parallel to the side walls 124 and 126 using the conveyor mechanism 112. The second portion 204 of the protrusions 106 pushes the page linearly. The dotted arrows 208 in FIG. 2C show the linear motion of the shaft 104 which enables the whirled page al to turn.

Figure 3A:
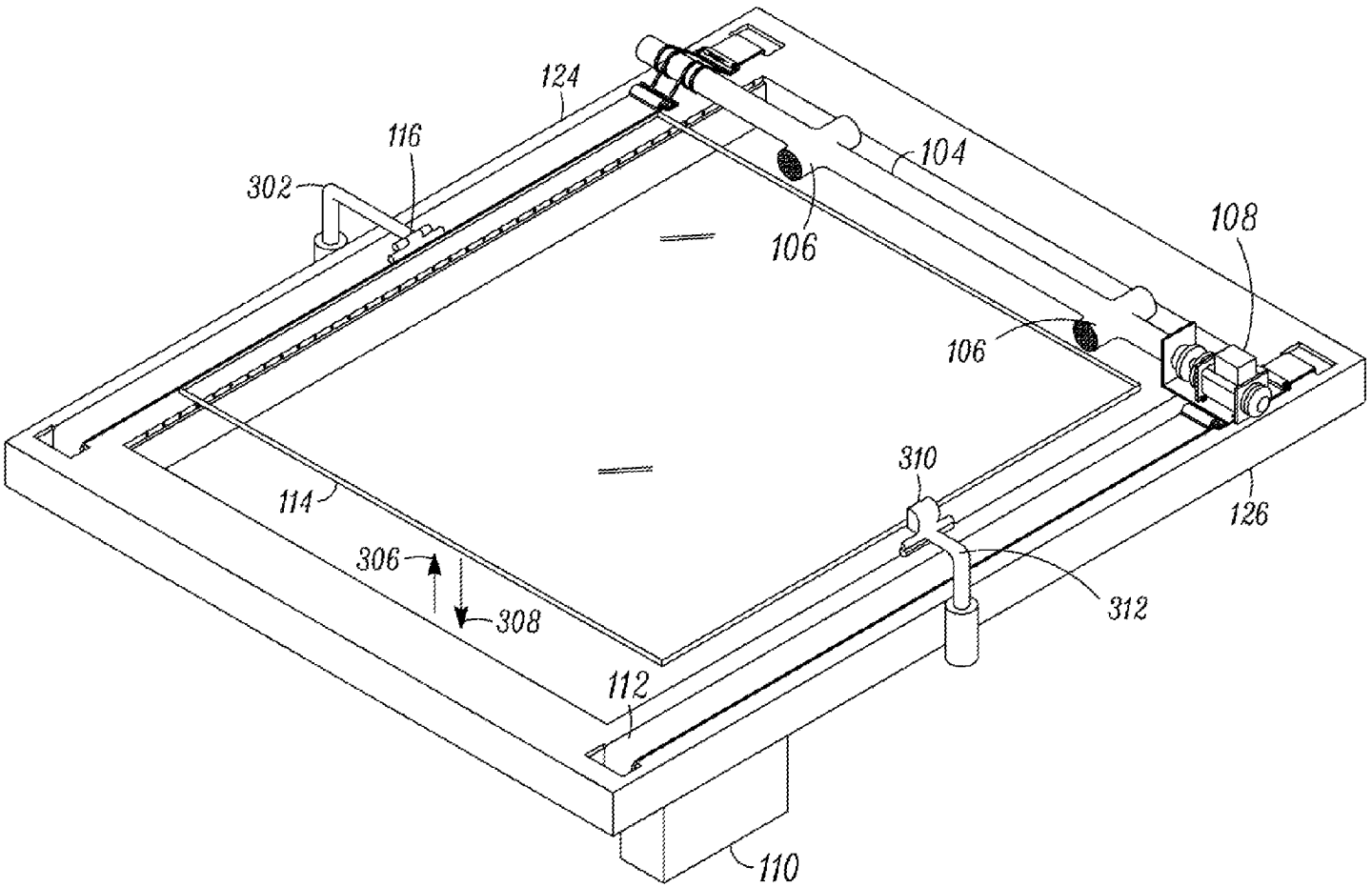
FIG. 3A and FIG. 3B depict a sheet connected to the page turning apparatus in accordance with various embodiments of the present invention.
Figure 3B:
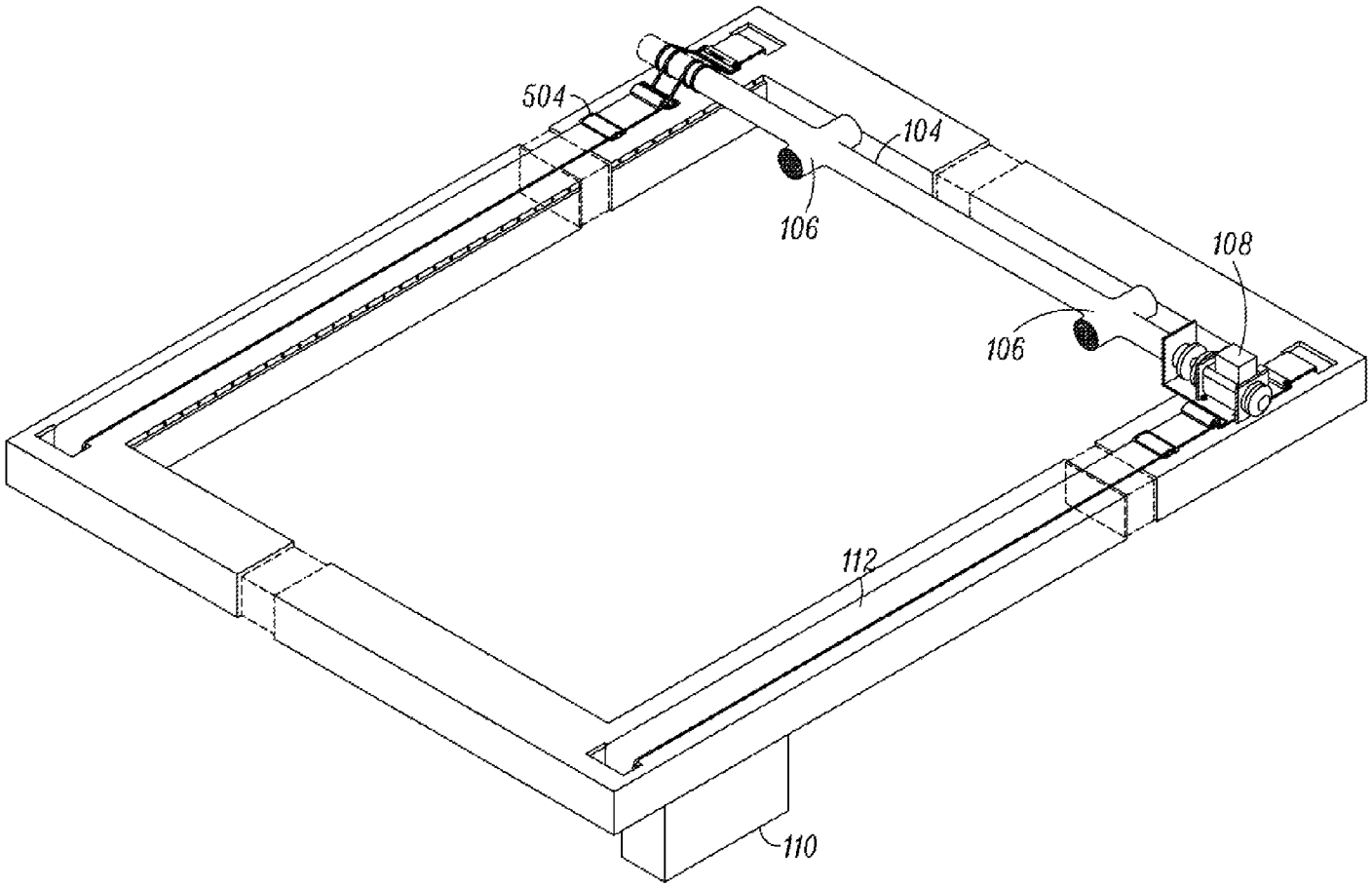

Referring to FIG. 3A and FIG. 3B, the sheet 114 mentioned above is connected to sides of the housing 102 using a connecting arm 302 and a connecting arm 312. The connecting arm 302 is connected to another energy means. In an embodiment of the present invention, the energy means can be a stepper motor. This energy means enables the sheet 114 to open before the turning of the page and close after the turning of the page. The opening and closing of the sheet 114 can be controlled by the microcontroller. As shown in the FIG. 3A, each of the connecting arm 302 and the connecting arm 312 can be connected to a solenoid (shown as a cylindrical solenoid).

In an embodiment of the present invention, on receiving the commands from the user interface to turn the page, the microcontroller give commands to the energy means to open the sheet 114 (shown by the dotted arrow 306). After the sheet 114 is opened, the respective energy means provide rotational and linear motion to the shaft 104. Once the page is turned by these motions, the microcontroller provides the commands to close the sheet 114 (shown by the dotted arrow 308).

In an embodiment of the present invention, the stepper motor 108 can provide rotational energy to both the sheet 114 and the shaft 104.

It may be noted that the sheet 114 is shown to be connected to the side wall 124 using the hinge mechanism 116; however those skilled in the art would appreciate that the sheet 114 can be connected to the side walls 126 using an appropriate arrangement presently known in the art. Similarly, the hinge mechanism 116 can be connected to the energy means and plastic sheet using any of the appropriate mechanism presently known in the art.

The hinge mechanism 116 enables opening of the sheet for putting a book into the page turning apparatus 100 or for taking out a book from the page turning apparatus 100. Once the sheet 114 is closed after page entry/exit of the book, it can be locked by a clip arrangement 310. The clip arrangement 310 is connected to the stepper motor 304 by the connecting arm 312 and the rod 314 and is placed on the side wall 126 or within an indented or recessed area within the side wall. As shown in FIG. 3B, the rod 314 connects the stepper motor 304 and the connecting arm 312 and extends in a direction perpendicular to the side walls 124 and 126. In an embodiment of the present invention, the stepper motor 304 provides a rotational motion for lifting the sheet 114 before the turning of the page. On lifting, the sheet 114 is opened and followed by the turning of the page. Once the page is turned, the sheet 114 is again lowered. In another embodiment of the present invention, the microcontroller provides commands to the stepper motor 304 to lift the sheet 114.

In an embodiment, the clip arrangement 310 is opened manually. For example, the user may want to remove the book currently in the housing to read another book instead. In this case, the user can unlock the clip arrangement 310 manually and change the book. In another embodiment of the present invention, an automatic means known in the prior art is connected to the clip 310 arrangement for opening and closing of the clip arrangement 310.

It may be noted that the clip arrangement 310 is shown to be connected to the connecting arm 312 and a solenoid; however those skilled in the art would appreciate that the clip arrangement 310 can be connected with any suitable arrangement presently know in the art. It may also be noted that the sheet 114 is shown to be connected using a hinge mechanism and other suitable mechanism with the housing 102. However, those skilled in the art would appreciate that the sheet 114 can be connected by using any other suitable mechanism presently known in the art. One such mechanism can be connecting the sheet 114 to the housing 102 by using solenoids. For example, each of the four corners of the sheet 114 can be connected by using a solenoid at each corner of the housing 102.

In an embodiment of the present invention, the sheet 114 may have small cut-outs. The cut outs will have marginally larger area than the protrusion heads. Once the page is turned and the sheet 114 is flat, the protrusions may rest directly on the page through these cut outs. In an embodiment of the present invention, the cut outs are placed to the right of where the words on the page stop and do not interfere with the viewing of the words. In an embodiment of the present invention, the sheet 114 may have smaller area than the area of the page. In this embodiment, the sheet 114 will be able to keep the pages flat. In addition, the paper of the book is exposed for the protrusions to rest.

In an embodiment of the present invention, once the page is turned and the sheet 114 is flat, the protrusions can rest on the edges of the housing 102. In an embodiment of the present invention, the housing 102 may have recess areas on its edges or sides. The protrusions can rest in these recess areas. It may be noted that the protrusions can rest in any of the appropriate place on the housing by using a suitable mechanism presently known in the art.

The page turning apparatus explained above does not include unreliable and noisy mechanisms, unwieldy preprocessing that needs clips or tabs to be attached to each page, and bulky devices with large components that reduce ease of portability. The apparatus owing to its design and structure makes page turning an effortless, mechanical function that serves the needs of the handicapped as well as the musician or anybody wishing to automate the page-turning and page place-holding process.

The page turner according to the present invention can handle a wide variety of book sizes, page thicknesses, and books whose pages are not conditioned to readily lie flat when the book is opened. Additionally, all mechanical movement can be coupled to a single motor, thereby enabling a low-cost design.

Although the present invention has been described in considerable detail with reference to certain preferred versions thereof, other versions are possible. Therefore, the spirit and scope of the appended claims should not be limited to the description of the preferred versions described herein.

All features disclosed in the specification, including the claims, abstracts and drawings, and all the steps in any method or process disclosed, may be combined in any combination except a combination where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means" for performing a specified function or "step" for performing a specified function, should not be interpreted as a "means" or "step" clause as specified in 35 U.S.C. §112.

All documents referenced herein are hereby incorporated by reference.

What is claimed is:

1. A page turning apparatus for books, the apparatus comprising:

a. a housing, the housing receiving a book;

b. a shaft operatively connected to the housing, the shaft rotating to whirl a page of the book and subsequently moving linearly to turn the page;

c. a first set of protrusions and a second set of protrusions on the shaft, d. one or more energy means, the one or more energy means providing a rotational and a linear motion to the shaft for turning the page of the book, wherein the rotational motion of the shaft is followed by the linear motion along a horizontal axis of the housing, and wherein the first set of protrusions grips and pull the page as the shaft rotates, and wherein the second set of protrusions slip under the page and push the page in such a manner to cause the page to flip as the shaft advances linearly to complete the page-turning process.

2. The page turning apparatus of claim 1, wherein the housing comprises:

a. a plurality of adjustable walls defining a compartment, and wherein the size of the compartment is adjusted based on the size of the book; and b. a conveyer mechanism for holding the shaft.

3. The page turning apparatus of claim 1, wherein the one or more protrusions is at least one of a one or more bolts, one or more screws, and one or more rubber caps.

4. The page turning apparatus of claim 3, wherein the at least one of the one or more bolts, one or more screws, and the one or more rubber caps are received by one or more holes in the shaft in a direction perpendicular to the axis of the shaft, and wherein a first portion and a second portion of each of the at least one or more bolts, one or more screws, and the one or more rubber caps are diametrically opposite and remains outside the shaft, and wherein a third portion remains inside the corresponding one or more holes.

5. The page turning apparatus of claim 4, wherein a first portion of each of the at least one or more bolts, one or more screws, and the one or more rubber caps makes contact with the page during the rotational motion of the shaft.

6. The page turning apparatus of claim 1, wherein the one or more energy means turn the page in one of a forward direction and a backward direction.

7. The page turning apparatus of claim 1 further comprising a microcontroller configured to control the rotational and the linear motion of the shaft based on predefined criteria, and wherein the predefined criteria is one or more of size of the book and direction of turning the page.

8. The page turning apparatus of claim 1 further comprising a lighting source operatively coupled to the adjustable housing for providing lighting to the reader, wherein the lighting source being one of a gooseneck light, LED array, and optical fiber lights.

9. The page turning apparatus of claim 1 further comprising a user interface for providing commands to turn the page, the user interface being one of mechanical interface, touch screen based interface, and voice command based interface.

10. The page turning apparatus of claim 1 further comprising a sheet for keeping the pages of the book flat, the sheet being hinged to one or more edges of the adjustable housing.

11. The page turning apparatus of claim 10, wherein the sheet comprises embedded lighting source.

12. The page turning apparatus of claim 11, wherein an LED array is positioned to intersect with the sheet when it is down in the reading position to illuminate the plastic sheet and subsequently illuminate the book pages.

13. The page turning apparatus of claim 10, wherein the sheet is a magnifying sheet.

14. The page turning apparatus of claim 1, wherein the one or more energy means comprises:

a. one or more stepper motors for providing the rotational motion to the shaft; and b. one or more linear actuators for providing the linear motion to the shaft.

15. The page turning apparatus of claim 1 further comprising a load balancing mechanism to independently provide stability and support to and providing upward pressure against each half of the book and cause both open pages to be at approximately the same level.

16. A page turning apparatus for books, the apparatus comprising:

a. a housing, the housing receiving a book;

b. a shaft operatively connected to the housing, the shaft rotating to whirl a page of the book and subsequently moving linearly to turn the page;

c. one or more protrusions on the shaft, the one or more protrusions making a first contact with the page for whirling the page;

d. a transparent screen attached to the housing;

e. one or more energy means, the one or more energy means providing a rotational and a linear motion to the shaft for turning the page of the book and to the transparent screen, wherein the rotational motion of the shaft is followed by the linear motion along a horizontal axis of the housing, and wherein a sheet opens up and lifts before the turning of the page and closes after the page is turned.

17. The page turning apparatus of claim 16 further comprising a lighting source operatively coupled to the adjustable housing for providing lighting to the reader.

18. The page turning apparatus of claim 16, wherein the one or more energy means comprises:

a. one or more stepper motors for providing the rotational motion to the shaft; and b. one or more linear actuators for providing the linear motion to the shaft.

19. A page turning apparatus for books, the apparatus comprising:

a. an adjustable housing, the housing receiving a book;

b. a shaft operatively connected to the housing, the shaft rotating to whirl a page of the book and subsequently moving linearly to turn the page;

c. one or more protrusions on the shaft, the one or more protrusions making a first contact with the page for whirling the page;

d. a transparent screen attached to the housing;

e. a first stepper motor for providing a rotational motion to the shaft to whirl the page;

f. a linear actuator to provide a linear motion to the shaft, wherein the rotational motion of the shaft is followed by the linear motion along a horizontal axis of the housing;

g. a second stepper motor to provide a rotational motion of the sheet, and wherein the sheet opens up before the turning of the page and closes after the page is turned.

20. The page turning apparatus of claim 19 further comprising a lighting source operatively coupled to the adjustable housing for providing lighting to the reader.

* * * * *